US007028994B2

(12) United States Patent
Sherikar

(10) Patent No.: US 7,028,994 B2
(45) Date of Patent: Apr. 18, 2006

(54) PRESSURE BLAST PRE-FILMING SPRAY NOZZLE

(75) Inventor: Sanjay V. Sherikar, Mission Viejo, CA (US)

(73) Assignee: IMI Vision, Warwickshire (GB)

( * ) Notice: Subject to any disclaimer, the term of this patent is extended or adjusted under 35 U.S.C. 154(b) by 33 days.

(21) Appl. No.: 10/795,013

(22) Filed: Mar. 5, 2004

(65) Prior Publication Data

US 2005/0194702 A1 Sep. 8, 2005

(51) Int. Cl.
*B01F 3/04* (2006.01)

(52) U.S. Cl. ..... 261/62; 261/118; 261/DIG. 13; 122/487; 137/542; 239/441

(58) Field of Classification Search ..... 261/62, 261/66, 118, DIG. 13; 122/487; 137/542; 239/439, 440, 441
See application file for complete search history.

(56) References Cited

U.S. PATENT DOCUMENTS 1,486,156 A * 3/1924 Needham ..... 239/440
2,127,188 A * 8/1938 Schellin et al. ..... 239/440
2,155,986 A * 4/1939 Wheaton ..... 261/116
2,277,811 A * 3/1942 Ashley et al. ..... 239/441
2,313,994 A * 3/1943 Grant ..... 239/440
2,323,464 A * 7/1943 Glessner ..... 239/441
4,512,520 A * 4/1985 Schoonover ..... 239/440
4,944,460 A * 7/1990 Steingass ..... 239/428.5
4,991,780 A * 2/1991 Kannan et al. ..... 239/440
6,619,568 B1 * 9/2003 Kunkle et al. ..... 239/452
6,691,929 B1 * 2/2004 Sherikar ..... 239/132.3
6,746,001 B1 6/2004 Sherikar

* cited by examiner

*Primary Examiner*—Scott Bushey
(74) *Attorney, Agent, or Firm*—Stetina Brunda Garred & Brucker

(57) ABSTRACT

Disclosed is a nozzle assembly having a nozzle housing and a valve element axially slidable therewithin between a closed and an open position. The nozzle housing has a housing inlet and a housing outlet fluidly interconnected by a plurality of housing passages. The valve element has a truncated conical valve body including a conical outer surface and a concave inner surface with a plurality of valve apertures extending through the valve body. The outer surface is sealingly engagable to a valve seat formed in the housing outlet such that the flow of cooling water through the valve apertures is prevented when the valve element is in the closed position. The outer surface and valve seat collectively define an annular gap when the valve element is axially displaced to the open position such that a portion of the cooling water flowing through the annular gap may pass through the valve apertures.

33 Claims, 3 Drawing Sheets

PRESSURE BLAST PRE-FILMING SPRAY NOZZLE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention pertains generally to steam desuperheaters and, more particularly, to a uniquely configured valve element for use in a nozzle assembly for a steam desuperheating device. The valve element is specifically adapted for creating a substantially uniformly distributed spray of cooling water for spraying into a flow of superheated steam in order to reduce the temperature thereof.

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional amounts of superheat.

A steam desuperheater can lower the temperature of superheated steam by spraying cooling water into a flow of superheated steam that is passing through a steam pipe. Once the cooling water is sprayed into the flow of superheated steam, the cooling water mixes with the superheated steam and evaporates, drawing thermal energy from the steam and lowering its temperature. If the cooling water is sprayed into the superheated steam pipe as very fine water droplets or mist, then the mixing of the cooling water with the superheated steam is more uniform through the steam flow.

On the other hand, if the cooling water is sprayed into the superheated steam pipe in a streaming pattern, then the evaporation of the cooling water is greatly diminished. In addition, a streaming spray of cooling water will pass through the superheated steam flow and impact the opposite side of the steam pipe, resulting in water buildup. This water buildup can cause erosion and thermal stresses in the steam pipe that may lead to structural failure. However, if the surface area of the cooling water spray that is exposed to the superheated steam is large, then the effectiveness of the evaporation is greatly increased.

In addition, the mixing of the cooling water with the superheated steam can be enhanced by spraying the cooling water into the steam pipe in a uniform geometrical flow pattern such that the effects of the cooling water are uniformly distributed throughout the steam flow. Likewise, a non-uniform spray pattern of cooling water will result in an uneven and poorly controlled temperature reduction throughout the flow of the superheated steam. Furthermore, the inability of the cooling water spray to efficiently evaporate in the superheated steam flow may also result in an accumulation of cooling water within the steam pipe. The accumulation of this cooling water will eventually evaporate in a non-uniform heat exchange between the water and the superheated steam, resulting in a poorly controlled temperature reduction.

Various desuperheater devices have been developed to overcome these problems. One such prior art desuperheater device attempts to avoid these problems by spraying cooling water into the steam pipe at an angle to avoid impinging the walls of the steam pipe. However, the construction of this device is complex with many parts such that the device has a high construction cost. Another prior art desuperheater device utilizes a spray tube positioned in the center of the steam pipe with multiple nozzles and a moving plug or slide member uncovering an increasing number of nozzles. Each of the nozzles is in fluid communication with a cooling water source. Although this desuperheater device may eliminate the impaction of the cooling water spray on the steam pipe walls, such a device is necessarily complex, costly to manufacture and install and requires a high degree of maintenance after installation.

As can be seen, there exists a need in the art for a desuperheater device for spraying cooling water into a flow of superheated steam that is of simple construction with relatively few components and that requires a minimal amount of maintenance. Furthermore, there exists a need in the art for a desuperheater device capable of spraying cooling water in a fine mist with very small droplets for more effective evaporation within the flow of superheated steam. Finally, there exists a need in the art for a desuperheater device capable of spraying cooling water in a geometrically uniform flow pattern for more even mixing throughout the flow of superheated steam.

BRIEF SUMMARY OF THE INVENTION

The present invention specifically addresses and alleviates the above referenced deficiencies associated with steam desuperheaters. More particularly, the present invention is an improved valve element for a nozzle assembly of a steam desuperheating device that is configured to spray cooling water into a flow of superheated steam in a generally uniformly distributed spray pattern.

The nozzle assembly is comprised of a nozzle housing and a valve element. The valve element, also commonly referred to as a valve pintle and a valve plug, extends through the nozzle housing and is axially slidable between a closed position and an open position. The nozzle housing has a housing inlet and a housing outlet. The housing inlet is located at an upper portion of the nozzle housing. The housing outlet is located at a lower portion of the nozzle housing. The upper portion of the nozzle housing defines a housing chamber for receiving cooling water from the housing inlet. The lower portion of the nozzle housing defines a pre-valve gallery that is separated from the housing chamber by an intermediate portion of the nozzle housing. A valve stem bore is axially formed through the intermediate portion.

A plurality of housing passages are formed in the intermediate portion to fluidly interconnect the housing chamber (i.e. the housing inlet) with the pre-valve gallery (i.e. the housing outlet) such that cooling water may enter the housing inlet, flow into the housing chamber, through the housing passages, and into the pre-valve gallery before exiting the housing assembly at the housing outlet when the valve element is displaced to the open position. The valve element comprises a truncated conical valve body and an elongate valve stem that is attached to the valve body and extends axially upwardly therefrom. The valve stem is advanced through the valve stem bore of the nozzle housing and is sized and configured to provide an axially sliding fit within the valve stem bore such that the valve element may be reciprocated between the open and closed positions. The lower portion of the nozzle housing includes a conical valve seat formed therearound for sealing engagement with the valve body.

The valve body includes a generally conical outer surface and a concave inner surface. The conical outer surface is sized and configured to be complementary to the valve seat such that the engagement of the outer surface to the valve seat defined by the lower portion of the nozzle housing effectively blocks the flow of cooling water out of the nozzle assembly when the valve element is in the closed position. Conversely, when the valve element is axially moved from the closed position to the open position, cooling water is able to flow downwardly through an annular gap collectively defined by the outer surface and the valve seat.

The conical outer surface and the concave inner surface collectively define a valve body wall having a plurality of angularly spaced-apart valve apertures extending between and fluidly connecting the outer surface to the inner surface. The valve apertures provide an additional passageway for cooling water exiting the nozzle assembly when the valve element is moved to the open position. The valve apertures are configured to allow of portion of the cooling water flowing through the annular gap to coat the outer surface of the valve body with a film of cooling water.

As the film of cooling water flows downwardly over the outer surface of the valve body, the cooling water passes through the valve apertures for eventual entry into the flow of superheated steam passing through the steam pipe. The body wall thickness is preferably kept to a minimum such that a length of each one of the valve apertures is also minimized in order to prevent the coalescence of relatively small water droplets into larger sized droplets. By keeping cooling water droplet size to a minimum, the absorption and evaporation efficiency of the cooling water within the flow of superheated steam is improved in addition to improving the spatial distribution of the cooling water.

The inner surface of the valve body has a generally hemispherical shape although it is contemplated that the inner surface may be configured in a variety of alternative configurations. The conical valve seat formed in the lower portion of the nozzle housing is sized and configured to be complementary to the conical configuration of the outer surface. In this regard, a half angle of the conical outer surface is preferably sized to be less than or greater than a half angle of the conical valve seat. Additionally, the half angle of the outer surface and the half angle of the valve seat is preferably between about thirty to about forty-five degrees. Therefore, if the outer surface half angle is about thirty-three degrees, then the valve seat half angle is preferably about thirty degrees.

The combination of the conical valve seat and conical outer surface is effective to induce a conical spray pattern for the cooling water that is exiting the annular gap when the valve element is in the open position. Advantageously, the passage of cooling water through the valve apertures provides for a substantially uniformly distributed conically-shaped spray pattern wherein the spatial distribution of droplets is more uniform across a transverse cross sectional area of the spray pattern as compared to the spray pattern resulting from a valve body having no valve apertures.

The valve apertures may be arranged in a single circumferential row or in multiple circumferential rows. Furthermore, the valve apertures may be disposed in equidistantly spaced relation to each other about the conical outer surface and may be axially aligned with the valve stem or angled inwardly or outwardly relative to the valve stem. The valve apertures may be of substantially equal cross sectional shape but may be provided in a variety of shapes, sizes, and configurations.

BRIEF DESCRIPTION OF THE DRAWINGS

These as well as other features of the present invention, will become more apparent upon reference to the drawings wherein.

DETAILED DESCRIPTION OF THE INVENTION

The present invention will now be described in particular with reference to the accompanying drawings.

Figure 1:
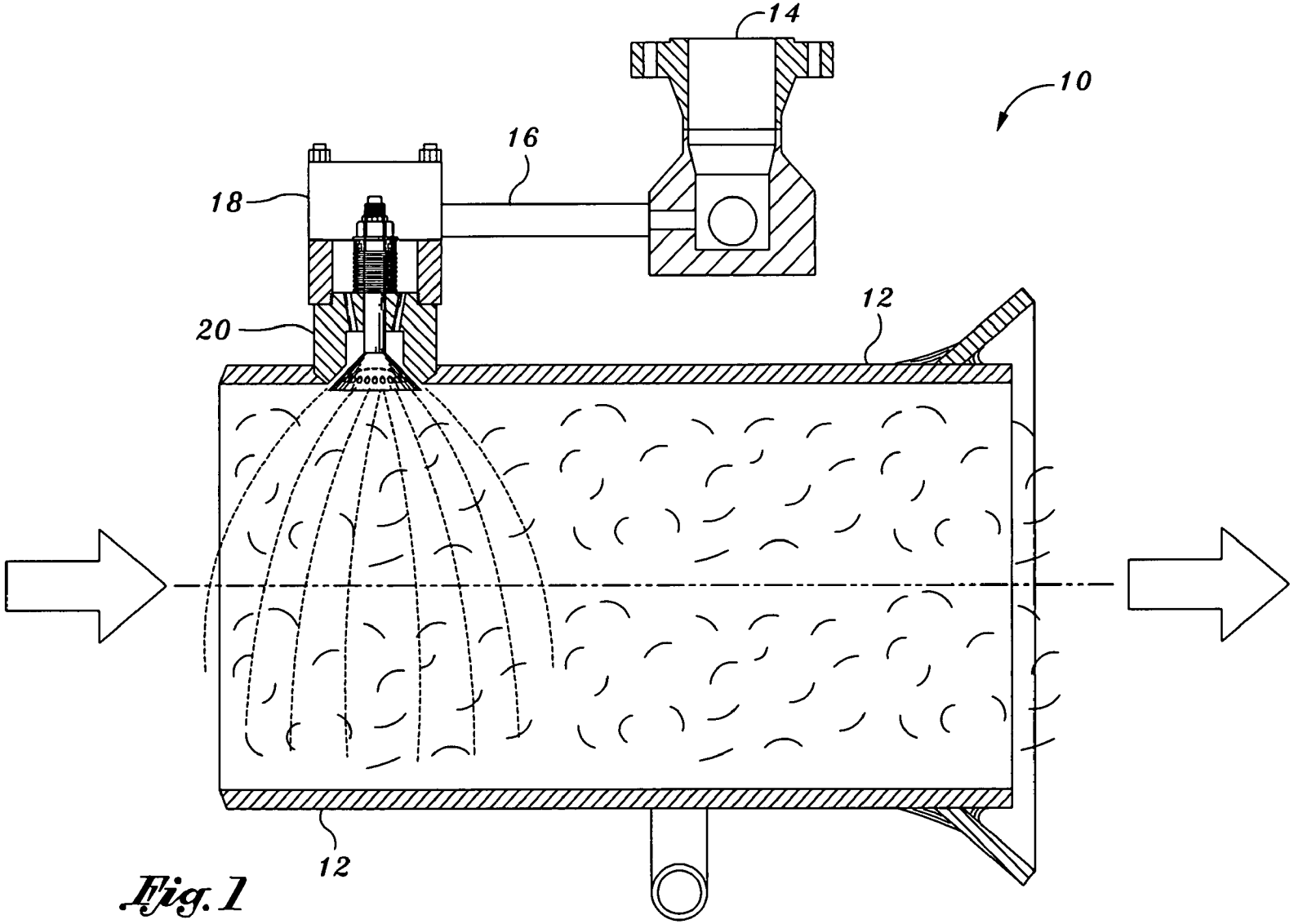
FIG. 1 is a longitudinal sectional view of a desuperheater device incorporating a nozzle assembly having a valve element of the present invention.

Referring to FIG. 1, shown is the desuperheating device 10 that incorporates an improved valve pintle or valve element 78 within a nozzle assembly 20. The valve element 78 extends through the nozzle assembly 20 and is axially slidable between a closed position and an open position. As can be seen in FIG. 1, a flow of superheated steam at elevated pressure passes through a steam pipe 12 to which the nozzle assembly 20 may be attached by suitable means such as by welding and the like. A nozzle holder 18 joins a cooling water feedline 16 to the nozzle assembly 20 for providing a suitable supply of cooling water thereto.

The cooling water feedline 16 is connected to a cooling water control valve 14. The cooling water control valve 14 may be fluidly connected to a high pressure water supply (not shown). The control valve 14 is operative to control the flow of cooling water into the cooling water feedline 16 in response to a temperature sensor (not shown) mounted in the steam pipe 12 downstream of the nozzle assembly 20. The control valve 14 may vary the flow through the cooling water feedline 16 in order to produce varying water pressure in the nozzle assembly 20.

When the cooling water pressure in the nozzle assembly 20 is greater than the elevated pressure of the superheated steam in the steam pipe 12, the nozzle assembly 20 provides a spray of cooling water into the steam pipe 12. Although FIG. 1 shows a single nozzle assembly 20 connected to the steam pipe 12, it is contemplated that there may be any number of nozzle assemblies 20 spaced around the circumference of the steam pipe 12 for optimizing the efficiency of the desuperheater device 10. Each nozzle assembly 20 may be connected via the cooling water feedline 16 to a manifold (not shown) encircling the steam pipe 12 and connected to the cooling water control valve 14. As will be described below, the valve element 78 of the nozzle assembly 20 is specifically adapted for creating a substantially uniformly distributed spray of cooling water for spraying into the flow of superheated steam in order to reduce the temperature thereof.

Figure 2B:
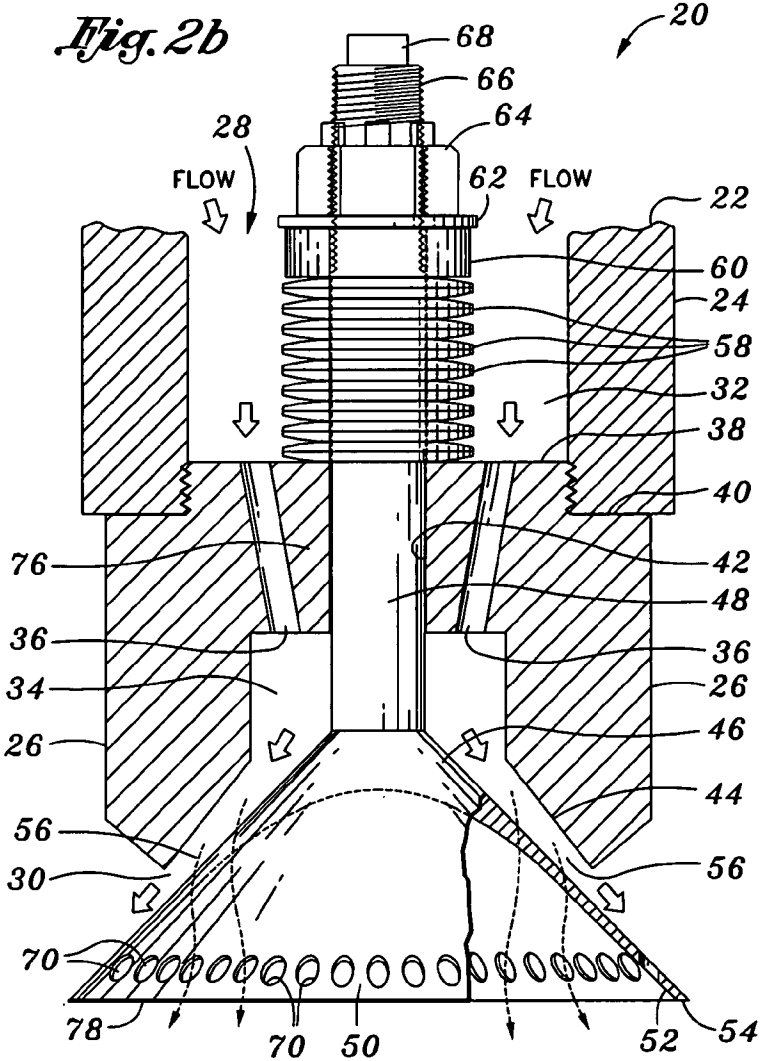
FIG. 2*b* is a longitudinal sectional view of the nozzle assembly of FIG. 1 illustrating the valve element in an open position.
Figure 2A:
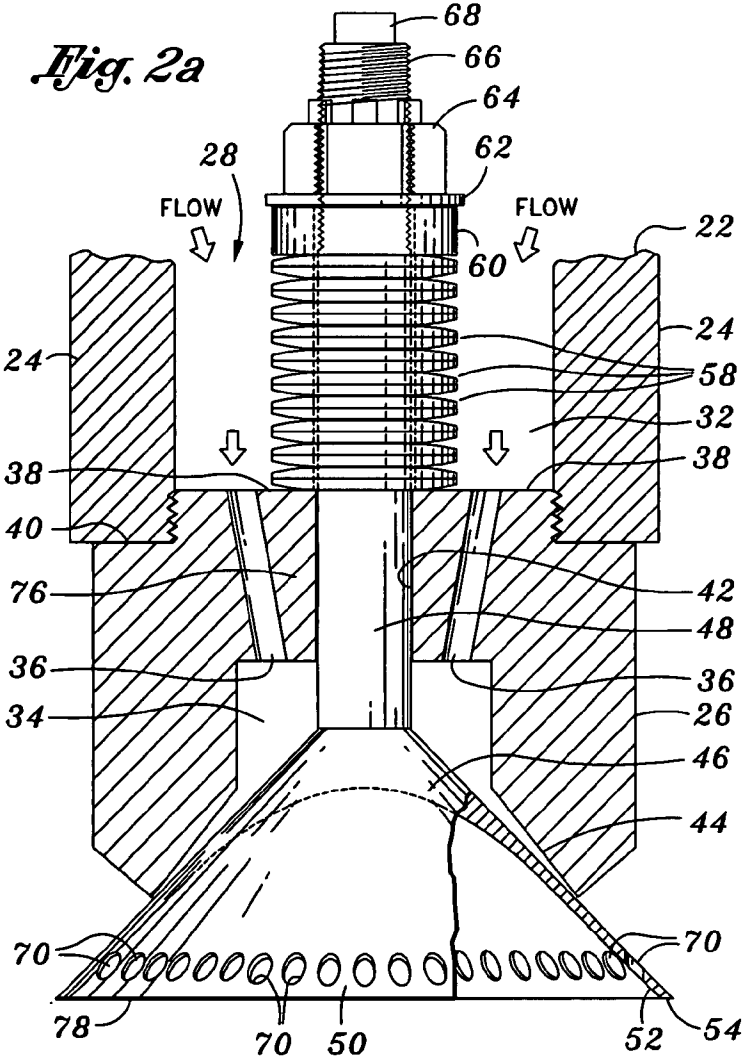
FIG. 2*a* is a longitudinal sectional view of the nozzle assembly of FIG. 1 illustrating a first embodiment of the valve element in a closed position.
Figure 3:
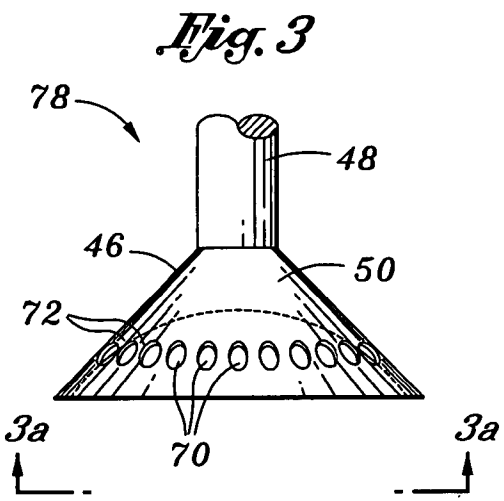
FIG. 3 is a side view of the valve element in the first embodiment.
Figure 3A:
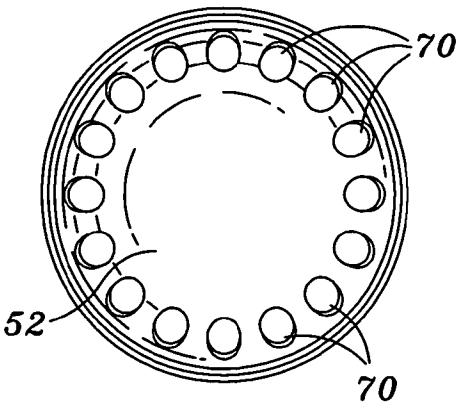
FIG. 3*a* is a bottom view of the valve element of the first embodiment.

Turning now to FIGS. 2*a* and 2*b*, shown is a sectional view of the nozzle assembly 20 of the desuperheating device 10 of FIG. 1. In FIGS. 2*a* and 2*b*, the nozzle assembly 20 is comprised of a nozzle housing 22 and the valve element 78 in a first embodiment. The valve element 78 of the first embodiment may also be seen in FIGS. 3 and 3*a*. The specific configuration and features of the first embodiment of the valve element 78 will be described in greater detail below. The nozzle assembly 20 is shown in FIG. 2*a* with the valve element 78 disposed in a closed position. FIG. 2*b* illustrates the valve element 78 disposed in an open position. The nozzle housing 22 has a housing inlet 28 and a housing outlet 30. The housing inlet 28 is located at an upper portion 24 of the nozzle housing 22. The housing outlet 30 is located at a lower portion 26 of the nozzle housing 22. The upper and lower portions 24, 26 may be integrated into a unitary structure.

Figure 5:
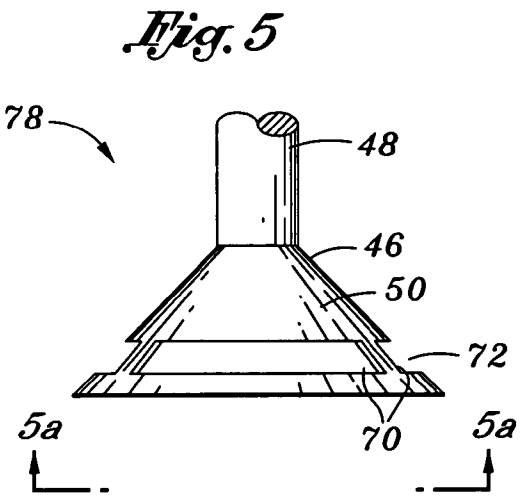
FIG. 5 is a side view of the valve element in a third embodiment.
Figure 4:
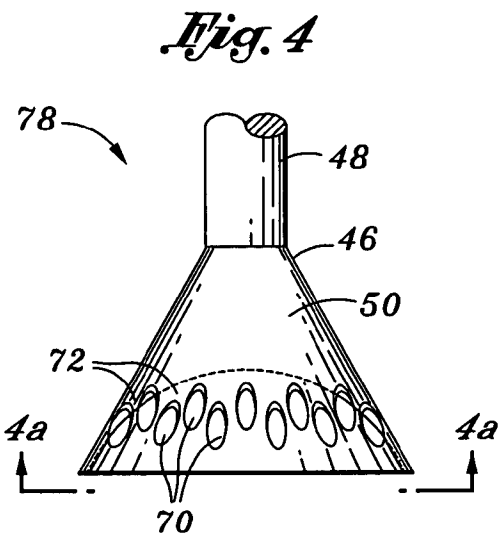
FIG. 4 is a side view of the valve element in a second embodiment.
Figure 5A:
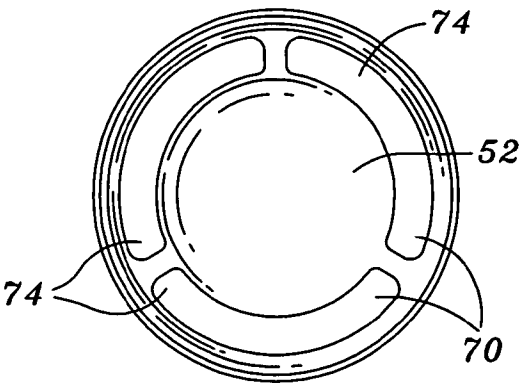
FIG. 5*a* is a bottom view of the valve element of the third embodiment.
Figure 4A:
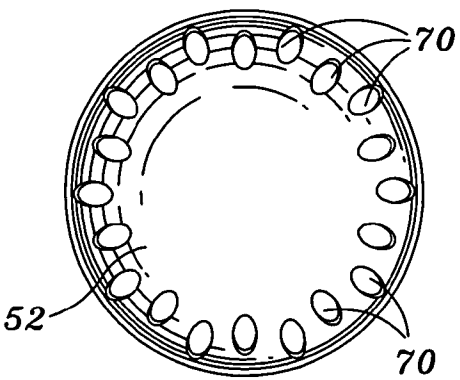
FIG. 4*a* is a bottom view of the valve element of the second embodiment.

Alternatively, the nozzle housing 22 may be fabricated as two separate components comprising the upper portion 24 and the lower portion 26 as is shown in FIGS. 2*a* and 2*b*. The upper portion 24 may be threadably attached to the lower portion 26 at an abutment 40 therebetween such that the valve element 78 and the lower portion 26 may be removed from the upper portion 24 and replaced with a valve element 78 and lower portion 26 of the same configuration or of an alternative configuration. Thus, it is contemplated that the valve element 78 may be interchangeable wherein a second or third embodiment of the valve element 78 may be substituted for the first embodiment. In this regard, FIGS. 4, 4*a* illustrate the valve element 78 in a second embodiment. FIGS. 5 and 5*a* illustrate the valve element 78 in a third embodiment. The specific configuration and features of the second and third embodiments of the valve element 78 will be described in greater detail below.

Referring still to FIG. 2*a*, the upper portion 24 of the nozzle housing 22 may define a housing chamber 32 for receiving cooling water from the housing inlet 28. The lower portion 26 of the nozzle housing 22 may define a pre-valve gallery 34 that is separated from the housing chamber 32 by an intermediate portion 76 of the nozzle housing 22. Both the housing chamber 32 and the pre-valve gallery 34 may be annularly shaped. A valve stem bore 42 may be axially formed through the intermediate portion 76 of the nozzle housing 22. A plurality of housing passages 36 are formed in the intermediate portion 76 to fluidly interconnect the housing chamber 32 (i.e. the housing inlet 28) with the pre-valve gallery 34 (i.e. the housing outlet 30) such that cooling water may flow from the housing inlet 28, into the housing chamber 32, through the housing passages 36, and into the pre-valve gallery 34 before exiting the nozzle assembly 20 at the housing outlet 30 when the valve element 78 is displaced to the open position.

As can be seen in FIG. 2*a*, the housing passages 36 may be angled inwardly relative to the valve stem bore 42 along a direction from the housing inlet 28 to the housing outlet 30. Such inward angling of the housing passages 36 may permit a general reduction in the overall size of the nozzle assembly 20. In addition, such inward angling of the housing passages 36 may facilitate the formation of the substantially uniform spray pattern of cooling water that is discharging from the nozzle assembly 20. The housing passages 36 may be concentrically disposed around and equidistantly spaced about the valve stem bore 42. However, the housing passages 36 may be configured in any number of configurations. For example, the housing passages 36 may be configured with substantially equal circular cross sectional shapes and may be axially aligned with the valve stem bore 42.

In addition, the housing passages 36 may be configured as a plurality of generally arcuately-shaped slots extending axially through the intermediate portion 76 in equidistantly spaced relation to each other. The housing passages 36 are spaced about the valve stem bore 42 in order to eliminate the tendency for the cooling water to exit the nozzle assembly 20 in a streaming spray pattern. In this regard, the combination of the housing passages 36 and the geometry of the valve element 78 are configured to cooperate in order to provide a geometrically uniform spray pattern of the cooling water into the steam pipe 12. Regardless of their specific geometric arrangement, size and shape, the housing passages 36 are configured to provide a flow of cooling water from the housing inlet 28 to the housing outlet 30 when the valve element 78 is moved to the open position, as will be described in greater detail below.

Referring still to FIGS. 2*a* and 2*b*, the valve element 78 comprises a truncated conical valve body 46 and an elongate valve stem 48. The valve stem 48 is attached to the valve body 46 and extends axially upwardly therefrom. The valve stem 48 is advanced through the valve stem bore 42 of the nozzle housing 22. The valve stem 48 may be sized and configured to be complementary to the valve stem bore 42 such that an axially sliding fit is provided therebetween. As will be described in greater detail below, the valve stem 48 may be reciprocated within the valve stem bore 42 such that the valve element 78 may be moved between the open and closed positions.

The lower portion 26 of the nozzle housing 22 at the housing outlet 30 includes a valve seat 44 formed therearound for sealing engagement with the valve body 46. The valve seat 44 may be outwardly angled in a conical configuration, as is shown in FIG. 2*a*. The valve body 46 includes a generally conical outer surface 50 and a concave inner surface 52. Preferably, the conical outer surface 50 is sized and configured to be complementary to the valve seat 44 such that the engagement of the outer surface 50 to the valve seat 44 defined by the housing outlet 30 effectively blocks the flow of cooling water out of the nozzle assembly 20 when the valve element 78 is in the closed position. Conversely, when the valve element 78 is axially moved from the closed position to the open position, cooling water is able to flow downwardly through an annular gap 56 collectively defined by the outer surface 50 and the valve seat 44.

Preferably, the conical outer surface 50 of the valve body 46 is configured such that its half angle differs from a half angle of the conical valve seat 44. More specifically, the half angle of the outer surface 50 is configured to be less than or greater than the half angle of the conical valve seat 44. Additionally, the half angle of the outer surface 50 and the half angle of the valve seat 44 are preferably between about thirty to about forty-five degrees. Therefore, if the outer surface 50 half angle is about thirty-three degrees, then the valve seat 44 half angle is preferably about thirty degrees. For configurations wherein the half angle of the outer surface 50 is less than the half angle of the valve seat 44, sealing engagement of the valve body 46 with the valve seat 44 will occur at a largest diameter of the valve seat 44 adjacent the housing outlet 30. Referring still to FIG. 2*a*, the valve body 46 may be configured such that a lower edge thereof extends beyond a lower edge of the lower portion 26 when the valve element 78 is in the closed position. In this configuration, the valve body 46 may protrude into the steam pipe 12.

Referring still to FIG. 2*a*, the conical outer surface 50 and the concave inner surface 52 collectively define a valve body wall 54. The valve body wall 54 has a plurality of angularly spaced-apart valve apertures 70 extending between and fluidly connecting the outer surface 50 to the inner surface 52. The valve apertures 70 are preferably positioned in the valve body 46 such that they are downstream of or below the lower edge of the valve seat 44 when the valve element 78 is in the closed position, as can be seen in FIG. 2*a*. Importantly, a thickness of the body wall 54 is preferably minimized in an area of the valve body 46 through which the valve apertures 70 are formed. The valve apertures 70 provide an additional passageway for cooling water exiting the nozzle assembly 20 when the valve element 78 is moved to the open position. The valve apertures 70 are configured to allow of portion of the cooling water flowing through the annular gap 56 to coat the outer surface 50 of the valve body 46 with a film of cooling water. As the film of cooling water flows downwardly over the outer surface 50 of the valve body 46, the cooling water passes through the valve apertures 70 for eventual entry into the flow of superheated steam passing through the steam pipe 12.

As was earlier mentioned, the valve body 46 may be configured such that the lower edge thereof extends beyond the lower edge of the lower portion 26 when the valve element 78 is in the closed position. Furthermore, the valve apertures 70 are preferably positioned downstream of the lower edge of the lower portion 26 when the valve element 78 is in the closed position. When the valve element 78 is in the open position, the combination of the extension of the valve body 46 lower edge beyond the lower portion 26 and the relative positioning of the valve apertures 70 has been shown to enhance breakup of cooling water droplets into relatively smaller sized droplets such that the cooling water exits the valve apertures 70 as a fine mist. Additional benefits realized by extending the valve body 46 lower edge and the valve apertures 70 beyond the lower portion 26 includes a reduction in impaction of the cooling water spray on an opposite side of the steam pipe 12 as well as a reduction in a shadowing effect of the cooling water spray.

As was earlier mentioned, the cooling water passes through the valve apertures 70 for eventual entry into the flow of superheated steam passing through the steam pipe 12. In this regard, the body wall 54 thickness is preferably kept to a minimum such that a length of each one of the valve apertures 70 is also minimized. By minimizing the length of each one of the valve apertures, 70 the coalescence of relatively small water droplets into larger sized droplets may be prevented such that cooling water exits the valve apertures 70 as a fine mist. By keeping cooling water droplet size to a minimum, the absorption and evaporation efficiency of the cooling water within the flow of superheated steam is improved in addition to improving the spatial distribution of the cooling water, as will be explained in greater detail below.

Regarding the configuration of the valve element 78 of the first embodiment of FIGS. 2*a*, 2*b*, 3*a* and 3*b*, the outer surface 50 may have a half angle of from about thirty degrees to about forty-five degrees. The valve seat 44 may have a complementary half angle that is preferably about three degrees less than that of the outer surface. For example, if the outer surface 50 half angle is about forty-five degrees, then the valve seat 44 half angle is preferably about forty-two degrees. Sealing engagement of the outer surface 50 with the valve seat 44 may therefore form a circular seal or line seal at the lower edge of the valve seat 44. As shown in FIGS. 2*a* and 2*b*, the lower edge of valve body 46 extends beyond the lower edge of the lower portion 26 when the valve element 78 is in the closed position. The inner surface 52 of the first embodiment as shown in FIGS. 2*a*, 2*b*, 3*a*, 3*b* may have a generally hemispherical shape although it is contemplated that the inner surface 52 may be configured in a variety of alternative configurations. For example, the inner surface 52 may have a generally conical shape that extends upwardly from the lower edge of the valve body 46 to intersect with a generally planar, horizontal surface. Alternatively, the inner surface 52 may have an ogive shape or an elliptical shape although a wide variety of other shapes may be incorporated into the inner surface 52.

The combination of the conical valve seat 44 and conical outer surface 50 is effective to induce a conical spray pattern for the cooing water that is exiting the annular gap 56 when the valve element 78 is in the open position. Advantageously, the passage of cooling water through the valve apertures 70 promotes a substantially uniformly distributed conically-shaped spray pattern. More specifically, in a transverse cross section of the spray pattern that is induced by a valve body 46 having valve apertures 70, the spatial distribution of droplets is more uniform across an area of the transverse cross section as compared to that resulting from a valve body 46 having no valve apertures 70. More specifically, the distribution of water droplets discharging from a valve body 46 having no valve apertures 70 tends to be concentrated at a perimeter of the transverse cross section with resulting slower dispersion and uneven mixing of the cooling water within the flow of superheated steam.

Referring still to FIGS. 2*a*, 2*b*, 3*a* and 3*b* showing the valve element 78 of the first embodiment, the valve apertures 70 may be arranged in a single circumferential row 72. Furthermore, the valve apertures 70 may be disposed in equidistantly spaced relation to each other about the conical outer surface 50. In the first embodiment of the valve element 78, each one of the valve apertures 70 define apertures axes that may be axially aligned with the valve stem 48 and may be of substantially equal circular cross sectional shape along an axial direction of the valve aperture 70. However, the aperture axis of each one of the valve apertures 70 may be formed at any angle relative to the valve stem 48. For example, the aperture axis of each on of the valve apertures 70 may be disposed substantially normal to the outer surface 50.

Although the valve apertures 70 of the first embodiment are shown as being generally axially aligned with the valve stem 48, the valve apertures 70 may be outwardly or inwardly angled or oriented relative to the valve stem 48. It has been shown that such outward or inward angling of the aperture axis of each one of the valve apertures 70 relative to the valve stem 48 provides a means to control the angle over which the cooling water spray exits the nozzle assembly 20. In addition, it is contemplated that the cross sectional shape of the valve apertures 70 may be provided in a variety of alternate configurations. For example, the valve apertures 70 may be configured with a generally elliptical cross sectional shape along the axial direction of the valve aperture 70.

Referring now to FIGS. 4 and 4*a*, shown is the valve element 78 in a second embodiment wherein the valve apertures 70 are arranged in two circumferential rows 72 with each valve aperture 70 in a circumferential row 72 being angularly offset from the valve aperture 70 in an adjacent one of the circumferential rows 72. In the second embodiment of the valve element 78, each one of the valve apertures 70 has a substantially equal generally elliptical cross sectional shape, as may be seen in FIG. 3*a*. Furthermore, in the valve element 78 of the second embodiment, each one of the valve apertures 70 in one of the circumferential rows 72 may be located at approximately a midpoint between adjacent ones of the valve apertures 70 in the adjacent one of the circumferential rows 72 such that the film of cooling water on the outer surface 50 may uniformly flow through each of the valve apertures 70. In this manner, the flow of cooling water through the valve apertures 70 may induce a more uniformly distributed spray pattern. As was earlier mentioned, the valve seat 44 is preferably configured such that the valve apertures 70 are positioned downstream of the lower edge of the lower portion 26 (i.e., downstream of the valve seat 44) when the valve element 78 is in the closed position.

Regarding the geometry of the valve body 46 of the second embodiment, the outer surface 50 has a half angle of from about thirty degrees to about forty-five degrees. Thus, the valve seat 44 may also have a complementary half angle of from about thirty degrees to about forty-five degrees. As was earlier mentioned, the half angle of the valve seat 44 is preferably about three degrees less than that of the outer surface 50. The inner surface 52 of the second embodiment as shown in FIGS. 4 and 4*a* has a generally conical shape that extends upwardly from the lower edge of the valve body 46 to intersect at a tangent of a generally hemispherical shape.

It should be noted that the valve apertures 70 in the second embodiment are preferably formed through a portion of the valve body 46 where the thickness of the valve body wall 54 is kept to a minimum. As was earlier mentioned, minimizing the body wall 54 thickness in turn results in a preferably minimal length of the valve aperture 70 in order to minimize the potential for coalescence of the cooling water into relatively large droplets as the cooling water film enters and passes through the valve apertures 70. Although the inner surface 52 of the second embodiment is described as having the conical shape transitioning into the hemispherical shape, it is contemplated that there are numerous shapes that may be incorporated into the inner surface 52 of the second embodiment.

Referring now to FIGS. 5 and 5*a*, shown is the valve element 78 in a third embodiment wherein the valve apertures 70 are configured as a plurality of generally arcuate slots 74 arranged in a single circumferential row 72. As shown in FIG. 4*a*, the valve apertures 70 are configured as three arcuate slots 74 disposed in equidistantly spaced relation to each other about the outer surface 50. Such an arrangement promotes the formation of a uniform spray pattern for more even mixing of the cooling water spray within the flow of superheated steam. The slots 74 may be outwardly or inwardly angled or oriented relative to the valve stem 48 in a manner similar to that described above for the valve apertures 70. For example, the slots 74 may be axially aligned with the valve stem 48. However, the slots 74 may be oriented normal to the outer surface 50.

It has been shown that such outward or inward angling of the slots 74 relative to the valve stem 48 provides a means to control the angle over which the cooling water spray exits the nozzle assembly 20. Regarding the geometry of the valve body 46 of the third embodiment, the outer surface 50 has a half angle of from about thirty degrees to about forty-five degrees. The valve seat 44 may also have a complementary half angle that is preferably about three degrees less than that of the outer surface 50. The inner surface 52 of the third embodiment as shown in FIGS. 5 and 5*a* is similar to the inner surface 52 of the first embodiment in that both embodiments have a generally hemispherical shape that extends upwardly from the lower edge of the valve body 46.

In each one of the above-described embodiments of the valve element 78, the valve stem 48 extending axially upwardly therefrom may have a threaded portion 66 formed on an upper end thereof. As seen in FIGS. 2*a* and 2*b*, the nozzle assembly 20 may include at least one valve spring 58 operatively coupled to the valve element 78 for biasing the valve element 78 in sealing engagement against the valve seat 44. The valve spring 58 abuts a housing shoulder 38 of the nozzle housing 22 and biases the valve body 46 in sealing engagement against the valve seat 44. Additionally, it is contemplated that the biasing force may be provided by at least one pair of belleville washers slidably mounted on the valve stem 48 in a back-to-back arrangement. Although nine pairs of belleville washers are shown mounted on the valve stem 48 in a back-to-back arrangement as shown in FIGS. 2*a* and 2*b*, there may be any number of belleville washers mounted on the valve stem 48. Although shown as belleville washers, it should be noted that the valve spring 58 may be configured in a variety of alternative configurations.

A spacer 60 may also be included in the nozzle assembly 20, as shown in FIGS. 2*a* and 2*b*. The spacer 60 is mounted on the valve stem 48 in abutment with the valve spring 58. The spacer 60 shown in FIGS. 2*a* and 2*b* is configured as a cylinder. The thickness of the spacer 60 may be selectively adjustable to limit the compression characteristics of the valve element 78 within the nozzle housing 22 such that the point at which the valve element 78 is moved from the closed position to the open position may be adjustable. In this regard, it is contemplated that for a given configuration of the nozzle assembly 20, spacers 60 of varying thickness may be substituted to provide some degree of controllability regarding the axial movement of the valve element 78 and, ultimately, the size of the annular gap 56 when the valve element 78 is in the open position.

Referring still to FIGS. 2*a* and 2*b*, also included in the nozzle assembly 20 is a valve stop 62 mounted on the valve stem 48. The valve stop 62 may be configured to extend beyond the diameter of the spacer 60 for configurations of the nozzle housing 22 that includes a spring bore (not shown) formed therethrough. In such configurations including a spring bore, the valve stop 62 may limit the axial movement of the valve element 78. In FIGS. 2*a* and 2*b*, the valve stop 62 is shown configured as a stop washer mounted on the valve stem 48 and disposed in abutting contact with the spacer 60. The stop washer may have a diameter greater than that of the spring bore for limiting the axial movement of the valve element 78 such that the size of the annular gap 56 may be limited.

As further shown in FIGS. 2*a* and 2*b*, the nozzle assembly 20 also includes a load nut 64 threadably attached to the threaded portion 66 of the valve stem 48. The load nut 64 may be adjusted to apply a spring preload to the valve spring 58 by moving the valve stem 48 and the spacer 60 axially relative to each other to squeeze the valve spring 58 between the spacer 60 and the housing shoulder 38. For configurations of the nozzle assembly 20 that do not include a spacer 60, the adjustment of the load nut 64 squeezes the valve spring 58 between the housing shoulder 38 and the valve stop 62. For configurations of the nozzle assembly 20 that do not include the valve stop 62, the adjustment of the load nut 64 squeezes the valve spring 58 between the load nut 64 and the housing shoulder 38 (or spring bore, if included).

In any case, the load nut 64 may be adjusted to apply a compressive force to the valve body 46 against the nozzle valve seat 44. The load nut 64 is selectively adjustable to regulate the point at which the pressure of cooling water in the pre-valve gallery 34 against the valve body 46 overcomes the combined pressure of the spring preload and the elevated pressure of the superheated steam against the valve body 46. The spring preload is thus transferred to the valve element 78 or valve body 46 against the valve seat 44. The amount of linear closing force exerted on the valve seat 44 by the valve spring 58 is adjusted by the axial position of the load nut 64 along the threaded portion 66 of the valve stem 48.

The valve stem 48 may include at least one pair of diametrically opposed flats 68 formed on the upper end thereof for holding the valve element 78 against rotation during adjustment of the load nut 64. The nozzle assembly 20 may further comprise a locking mechanism for preventing rotation of the load nut 64 after adjustment. Such a locking mechanism may be embodied in a configuration wherein the valve stem 48 has a diametrically, disposed cotter pin hole (not shown) formed through the upper end thereof, and the load nut 64 is a castle nut having at least one pair of diametrically opposed grooves with a cotter pin (not shown) that extends through the castle nut grooves and through the cotter pin hole.

In operation, a flow of superheated steam at elevated pressure passes through the steam pipe 12, to which the nozzle housing 22 is attached, as is shown in FIG. 1. The cooling water feedline 16 provides a supply of cooling water to the nozzle assembly 20. The control valve 14 varies the flow through the cooling water feedline 16 in order to control water pressure in the nozzle assembly 20. Cooling water exiting the cooling water feedline 16 passes into the housing chamber 32 adjacent the housing inlet 28. The cooling water flows through the housing passages 36 of the nozzle housing 22 and into the pre-valve gallery 34 adjacent the housing outlet 30. The housing passages 36 minimize or eliminate a tendency for the cooling water to exit the nozzle assembly 20 in a streaming spray. The cooling water in the pre-valve gallery 34 bears against the valve body 46 when the valve element 78 is in the closed position as shown in FIG. 2*a*.

As was mentioned above, the adjustment of the load nut 64 squeezes the valve spring 58 to apply a compressive force to the valve body 46 against the valve seat 44. In this regard, the spring preload serves to initially hold the valve element 78 in the closed position, as shown in FIG. 2*a*. The amount of linear closing force exerted on the valve seat 44 by the valve spring 58 is adjusted by rotating the load nut 64 along the threaded portion 66 of the valve stem 48. The load nut 64 is selectively adjustable to regulate the point at which the pressure of cooling water in the pre-valve gallery 34 against the valve body 46 overcomes the combined pressure of the spring preload and the elevated pressure of the superheated steam acting against the inner surface 52 of the valve body 46.

When the pressure of the cooling water against the valve body 46 overcomes the combined pressure of the spring preload and the elevated pressure of the superheated steam, the valve body 46 moves axially away from the valve seat 44, opening the annular gap 56, as shown in FIG. 2*b*. Cooling water can then flow through the annular gap 56 and into the steam pipe 12 containing the flow of superheated steam. When the control valve 14 increases the water flow through the cooling water feedline 16 in response to a signal from the temperature sensor, an increase in cooling water pressure against the valve body 46 occurs, forcing the valve body 46 axially further away from the valve seat 44 and further increasing the size of the annular gap 56. This in turn allows for a greater amount of cooling water to pass through the annular gap 56 and into the flow of superheated steam.

Due to the combination of the truncated conical shape of the valve body 46 and the valve apertures 70 formed therethrough, the cooling water enters the steam pipe 12 in a cone-shaped pattern of a generally uniform fine mist spray pattern consisting of very small water droplets. The uniform mist spray pattern ensures a thorough and uniform mixing of the cooling water with the superheated steam flow. The uniform mist pattern also maximizes the surface area of the cooling water spray and thus enhances the evaporation rate of cooling water.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A nozzle assembly for a desuperheating device configured for spraying cooling water, the nozzle assembly comprising:

a nozzle housing having a housing inlet and a housing outlet fluidly interconnected by a plurality of housing passages, the housing outlet defining a valve seat; and a valve element disposed within the nozzle housing and axially slidable therewithin between a closed and an open position, the valve element having a truncated conical valve body including a conical outer surface and a concave inner surface a portion of the conical valve body extending downstream of the valve seat, the inner and outer surfaces collectively defining a body wall with a plurality of valve apertures extending therethrough the apertures being provided within the portion of the conical valve body that extends downstream of the valve seat;

wherein the outer surface is sealingly engagable to the valve seat such that the flow of cooling water through the valve apertures is prevented when the valve element is in the closed position, the outer surface and the valve seat collectively defining an annular gap when the valve element is axially displaced to the open position such that a portion of the cooling water flowing through the annular gap may subsequently pass through the valve apertures.

2. The nozzle assembly of claim 1 wherein the concave inner surface has a substantially hemispherical shape.

3. The nozzle assembly of claim 1 wherein the valve apertures are spaced about the conical outer surface in a single circumferential row.

4. The nozzle assembly of claim 3 wherein the valve apertures are axially aligned and are of substantially equal circular cross sectional shape in an axial direction, the valve apertures being disposed in equidistantly spaced relation to each other about the outer surface.

5. The nozzle assembly of claim 3 wherein each one of the valve apertures defines an aperture axis that is angled relative to the valve stem.

6. The nozzle assembly of claim 5 wherein the aperture axis of each one of the valve apertures is oriented substantially normal to the outer surface.

7. The nozzle assembly of claim 1 wherein the valve apertures are arranged in two circumferential rows with each valve aperture in a row being angularly offset from the valve aperture in an adjacent one of the rows.

8. The nozzle assembly of claim 1 wherein the valve apertures are of substantially equal elliptical cross sectional shape.

9. The nozzle assembly of claim 7 wherein each of the valve apertures in one of the rows is located at approximately a midpoint between adjacent ones of the valve apertures in the adjacent one of the rows.

10. The nozzle assembly of claim 1 wherein the valve apertures are configured as a plurality of arcuate slots arranged in a single circumferential row.

11. The nozzle assembly of claim 10 wherein the valve apertures are configured as three arcuate slots disposed in equidistantly spaced relation to each other about the outer surface.

12. A nozzle assembly for a desuperheating device configured for spraying cooling water, the nozzle assembly comprising:

a nozzle housing having a valve stem bore formed axially therethrough and including a housing inlet and a housing outlet fluidly interconnected by a plurality of housing passages spaced about the valve stem bore for providing a flow of the cooling water from the housing inlet to the housing outlet, the housing outlet defining an outwardly angled conical valve seat; and a valve element having an elongate valve stem extending from a truncated conical valve body including a conical outer surface and a concave inner surface a portion of the conical valve body extending downstream of the valve seat, the valve stem being axially slidable within the valve stem bore between a closed and an open position, the inner and outer surfaces collectively defining a body wall with a plurality of angularly spaced-apart valve apertures extending between and fluidly connecting the outer surface to the inner surface, the apertures being provided within the portion of the conical valve body that extends downstream of the valve seat the outer surface being configured to be complementary to the valve seat with the outer surface being sealingly engagable thereto such that the flow of cooling water through the valve apertures is prevented when the valve element is in the closed position;

wherein the outer surface and the valve seat collectively define an annular gap when the valve element is axially displaced to allow a portion of the cooling water flowing through the annular gap to coat the outer surface and subsequently pass through the valve apertures such that the cooling water exiting the nozzle assembly defines a substantially uniformly distributed conically-shaped spray pattern.

13. The nozzle assembly of claim 12 wherein the concave inner surface has a substantially hemispherical shape.

14. The nozzle assembly of claim 12 wherein the valve apertures are spaced about the conical outer surface in a single circumferential row.

15. The nozzle assembly of claim 14 wherein the valve apertures are axially aligned with the valve stem and are of substantially equal circular cross sectional shape in an axial direction, the valve apertures being disposed in equidistantly spaced relation to each other about the outer surface.

16. The nozzle assembly of claim 12 wherein each one of the valve apertures defines an aperture axis that is angled relative to the valve stem.

17. The nozzle assembly of claim 16 wherein the aperture axis of each one of the valve apertures is oriented substantially normal to the outer surface.

18. The nozzle assembly of claim 12 wherein the valve apertures are arranged in two circumferential rows with each valve aperture in a row being angularly offset from the valve aperture in an adjacent one of the rows.

19. The nozzle assembly of claim 12 wherein the valve apertures are of substantially equal elliptical cross sectional shape.

20. The nozzle assembly of claim 18 wherein each of the valve apertures in one of the rows is located at approximately a midpoint between adjacent ones of the valve apertures in the adjacent one of the rows.

21. The nozzle assembly of claim 12 wherein the valve apertures are configured as a plurality of arcuate slots arranged in a single circumferential row.

22. The nozzle assembly of claim 21 wherein the valve apertures are configured as three arcuate slots disposed in equidistantly spaced relation to each other about the outer surface.

23. A valve element configured for use in a nozzle housing having a valve stem bore formed axially therethrough and having a housing inlet and a housing outlet fluidly interconnected by a plurality of housing passages, the housing outlet defining a valve seat, the valve element comprising:

a truncated conical valve body axially slidable within the nozzle housing between a closed and an open position and including a conical outer surface and a concave inner surface a portion of the conical valve body extending downstream of the valve seat, the inner and outer surfaces collectively defining a body wall with a plurality of valve apertures extending therethrough the apertures being provided within the portion of the conical valve body that extends downstream of the valve seat;

wherein the outer surface is sealingly engagable to the valve seat such that the flow of cooling water through the valve apertures is prevented when the valve element is in the closed position, the outer surface and the valve seat collectively defining an annular gap when the valve element is axially displaced to the open position such that a portion of the cooling water flowing through the annular gap may subsequently pass through the valve apertures.

24. The nozzle assembly of claim 23 wherein the concave inner surface has a substantially hemispherical shape.

25. The nozzle assembly of claim 23 wherein the valve apertures are spaced about the conical outer surface in a single circumferential row.

26. The nozzle assembly of claim 25 wherein the valve apertures are axially aligned with the valve stem and are of substantially equal circular cross sectional shape in an axial direction, the valve apertures being disposed in equidistantly spaced relation to each other about the outer surface.

27. The nozzle assembly of claim 23 wherein each one of the valve apertures defines an aperture axis that is angled relative to the valve stem.

28. The nozzle assembly of claim 27 wherein the aperture axis of each one of the valve apertures is oriented substantially normal to the outer surface.

29. The nozzle assembly of claim 23 wherein the valve apertures are arranged in two circumferential rows with each valve aperture in a row being angularly offset from the valve aperture in an adjacent one of the rows.

30. The nozzle assembly of claim 23 wherein the valve apertures are of substantially equal elliptical cross sectional shape.

31. The nozzle assembly of claim 29 wherein each of the valve apertures in one of the rows is located at approximately a midpoint between adjacent ones of the valve apertures in the adjacent one of the rows.

32. The nozzle assembly of claim 23 wherein the valve apertures are configured as a plurality of arcuate slots arranged in a single circumferential row.

33. The nozzle assembly of claim 32 wherein the valve apertures are configured as three arcuate slots disposed in equidistantly spaced relation to each other about the outer surface.

* * * * *